United States Patent [19]

Ishihara et al.

[11] Patent Number: 4,610,048

[45] Date of Patent: Sep. 9, 1986

[54] HAND HELD VACUUM CLEANER

[76] Inventors: Naoki Ishihara, Flat 209, Viking Villas, No. 70, Tin Haw Temple Road; Choy K. Kuen, No. 1, Ching Ling, Gerr. 1st Floor, Flat D, both of Hong Kong, Hong Kong

[21] Appl. No.: 758,839

[22] Filed: Jul. 25, 1985

Related U.S. Application Data

[63] Continuation of Ser. No. 522,117, Aug. 11, 1983, abandoned.

[51] Int. Cl.[4] ..... A47L 5/24

[52] U.S. Cl. ..... 15/344; 15/414

[58] Field of Search ..... 15/327 F, 301, 315, 15/344, 350, 351, 414

[56] References Cited

U.S. PATENT DOCUMENTS

| | | | |
|---|---|---|---|
| 1,217,817 | 2/1917 | Peters | 15/315 X |
| 2,972,160 | 2/1961 | Hahn | 15/344 |
| 3,359,025 | 12/1967 | Nilsson | 15/327 F X |
| 4,011,624 | 3/1977 | Proett | 15/344 |
| 4,050,003 | 9/1977 | Owings et al. | 320/2 |
| 4,050,113 | 9/1977 | Wright et al. | 15/315 |
| 4,209,875 | 7/1980 | Pugh et al. | 15/344 |
| 4,249,799 | 2/1981 | Iglesias | 403/330 |

FOREIGN PATENT DOCUMENTS

| | | | |
|---|---|---|---|
| 133778 | 2/1933 | Austria | 15/315 |
| 306147 | 9/1968 | Sweden | 15/327 F |
| 877883 | 9/1961 | United Kingdom | 15/344 |
| 2028025 | 2/1980 | United Kingdom | 320/2 |

*Primary Examiner*—Harvey C. Hornsby
*Assistant Examiner*—Frankie L. Stinson
*Attorney, Agent, or Firm*—Moonray Kojima

[57] ABSTRACT

A hand held vacuum cleaner comprising a first unit interconnected with a second unit by a locking mechanism. The first unit comprises an extendable telescoping mouth section, and the second unit comprises a motor, fan, handle, and filter. The locking mechanism comprises a resiliently held button on the second unit, which interlocks with a hole in the first unit, and a pair of protrusions on the sides of the second unit, and channels corresponding thereto in the walls of the sides of the first unit, whereby the protrusions and channels are snugly fitted together by pushing the two units together in a straight line, with the button fitting into the hole. The telescoping mouth enables the cleaner to have access to otherwise inaccessible parts to be cleaned. Seals are provided for preventing the cylinders from becoming contaminated with dust.

In an alternative locking arrangement, a pair of protrusions and aligned holes on the two units are used with a button to retract the protrusions from the holes to release the two units.

19 Claims, 9 Drawing Figures

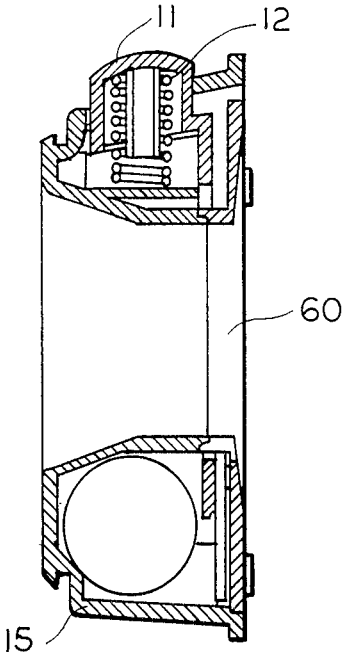
FIG. 7
FIG. 8
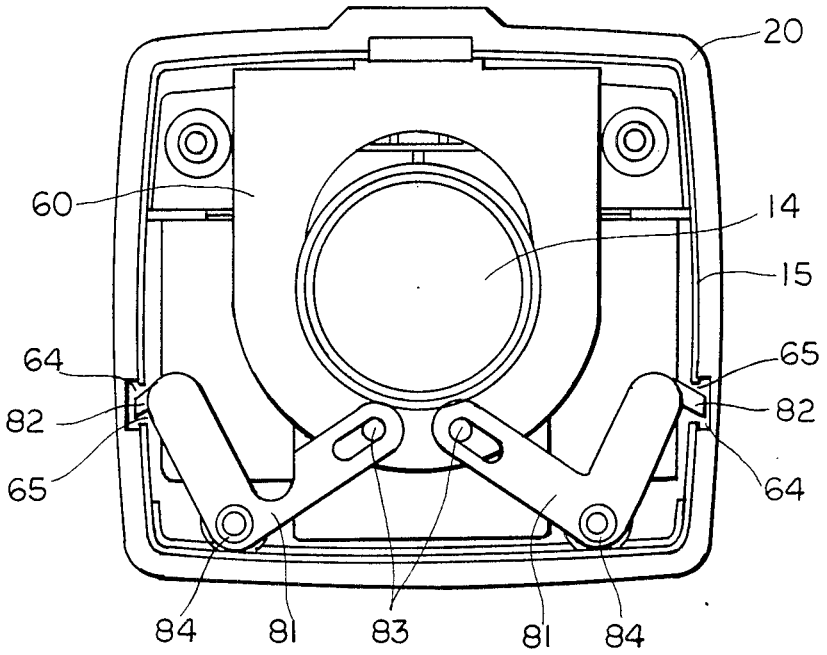

HAND HELD VACUUM CLEANER

This is a continuation of application Ser. No. 522,117 filed Aug. 11, 1983, now abandoned.

BACKGROUND OF THE INVENTION

1. Field of Invention

This invention relates to hand held vacuum cleaners and more particularly to hand held vacuum cleaners which have dust free extension mouth and mechanism for ready removal of dust.

2. Discussion of Prior Art

Hand held vacuum cleaners are known and have extensive utility due to their convenience, size and flexibility of movement. However, there are certain disadvantages which exist in prior art apparatus. For example, in one type of prior aparatus, there is a bowl section and a handle section, with a detachable filter which fits in the bowl section. The bowl and handle sections are attached together by locking mechanism requiring pivotal rocking motion so that the dust filter will stay in the bowl section. The bowl section has a mouth and a dust collection section. Disadvantageously, the mouth often cannot reach smaller spaces, thus detracting from usefullness of prior vacuum cleaners.

SUMMARY OF THE INVENTION

Accordingly, an object of the invention is to overcome the aforementioned and other disadvantages and deficiencies of the prior art.

Another object is to provide a mechanism for easy locking and unlocking of a dust collection section anc handle section of a hand held vacuum cleaner.

A further object is to provide a mechanism for enabling the mouth of the vacuum cleaner to reach difficult to reach places.

The foregoing and other objects are attained by the invention which encompasses a hand held vacuum cleaner comprising first and second units interconnected by a locking mechanism, with the first unit having an extendable mouth with dust free seal and space for collecting dust, and the second unit comprising a housing for motor, fan, rechargeable battery and filter arrangement and having a handle. The operation of the motor and fan to cause vacuum cleaning action through the mouth and collection of dust without the dust being drawn into the fan by the use of filter, are known, and are not further discussed herein for sake of convenience and simplicity of description. Incorporated by reference is U.S. Pat. No. 4,209,875 which discloses such operation. Advantageously, in this present invention, the mouth comprises a telescoping tube of two or more sections tightly sealed against dust escaping therefrom, and extendible to outside the first unit to reach otherwise inaccessible places. The telescoping tubes are sealed at their interconnecting part so that the dust will go through the open mouth and exit its other end without any leakage at the interconnection points. The other end is sealed within the first unit with a dust collection space, so that dust will not come into contact with the interconnection points of the tubes.

Also, advantageously, the locking means comprises a resilient push button on a part of the second unit which interconnects with the first unit, with the first unit having a hole through which the button interconnects for locking by spring means. The locking mechanism further comprises a protrusion on both sides of the second unit and at corresponding inside side locations in the first unit a pair of channels, so that the first unit can be tightly slid into engagement with the second unit, with the channels fitting about the protrusions, and with the hole in the first unit taking in the button on the second unit. To release the first and second units, the button is pushed down against the resilient force of the spring, and the two units are pulled apart in a straight line.

In an alternative locking arrangement, a pair of holes is provided in each side wall of both units in alignment with each other when the two units are interlocked. A locking piece having two extended protrusions is disposed in the second unit in contact with the button so as to be moveable by the button. The protrusions are normally projected outwardly through the holes in the side walls of the second unit, and when the two units are interlocked, outwardly through the aligned holes in the side walls of both units. To unlock the two units or to prepare the two units for locking, the button is pushed downward so as to retract the protrusions of the locking piece inward to be within the walls of the second unit and through the holes in the first unit (in which case the two units are interconnected). The top button in the locked condition will be within the top hole of the first unit, as previously discussed. Advantageously, the side holes in the second unit and the protrusions of the locking piece are angled at 45° or less so that when the button pushes downwardly, the resulting angular force will cause the protrusions to travel inward and retract the protrusions.

In another feature of the invention, a charging holder is provided with a base, two posts, a plug holder and recharging plug held in the holder, and posts in the base which can hold in wrapped condition a cord attached to the plug, and means for holding the recharging unit and with an outlet plug which can be inserted into an outside supply.

BRIEF DESCRIPTION OF THE DRAWINGS

FIG. 7 depicts a partial cutaway side view of the interconnecting part showing another locking arrangment.

FIG. 8 depicts a partial cutaway end view of the interconnecting part and first unit with the other locking arrangement.

DETAILED DESCRIPTION OF PREFERRED EMBODIMENTS

Figure 1A:
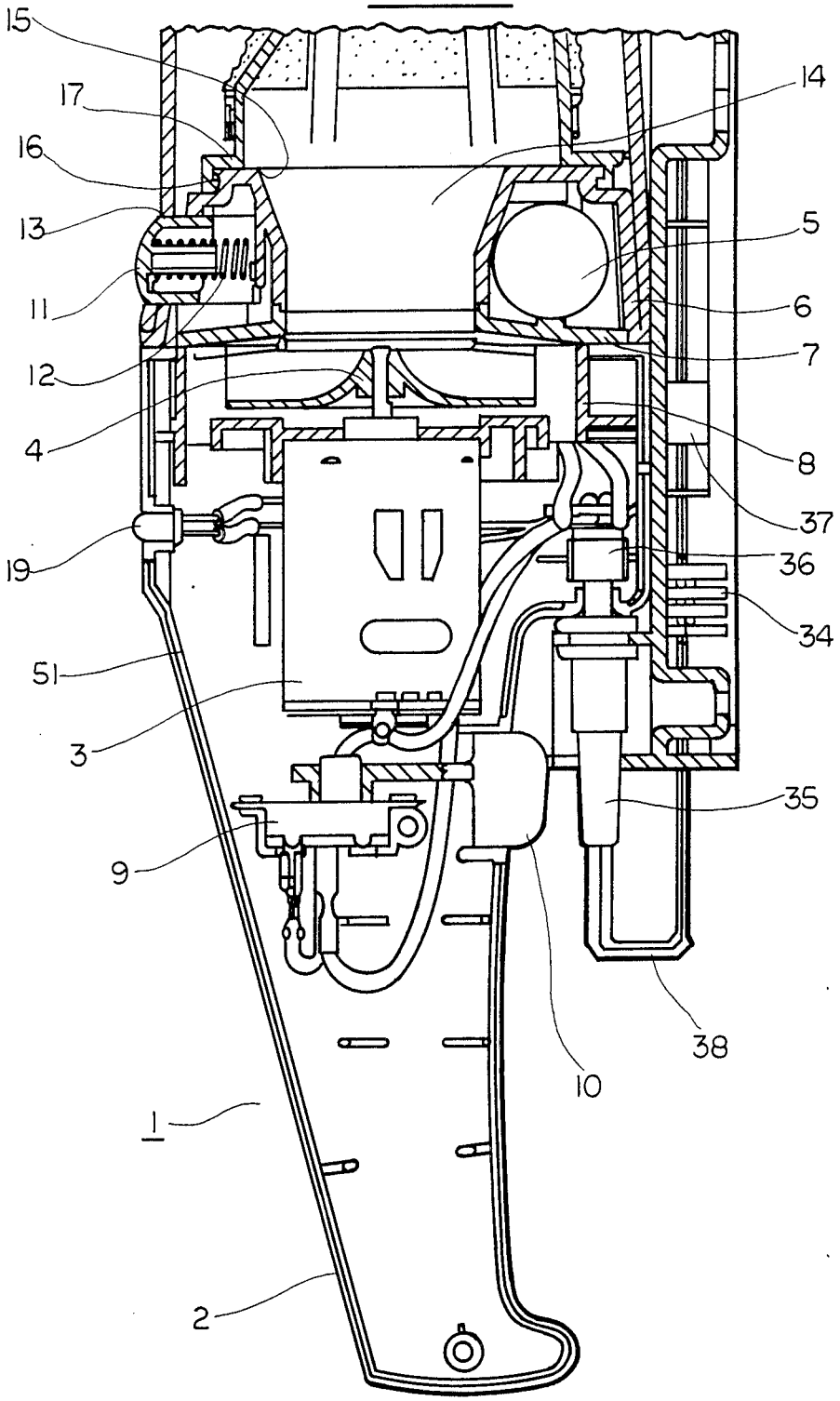
FIGS. 1A and 1B together depict an elevational view in cross section of an illustrative embodiment of the invention.
Figure 1B:
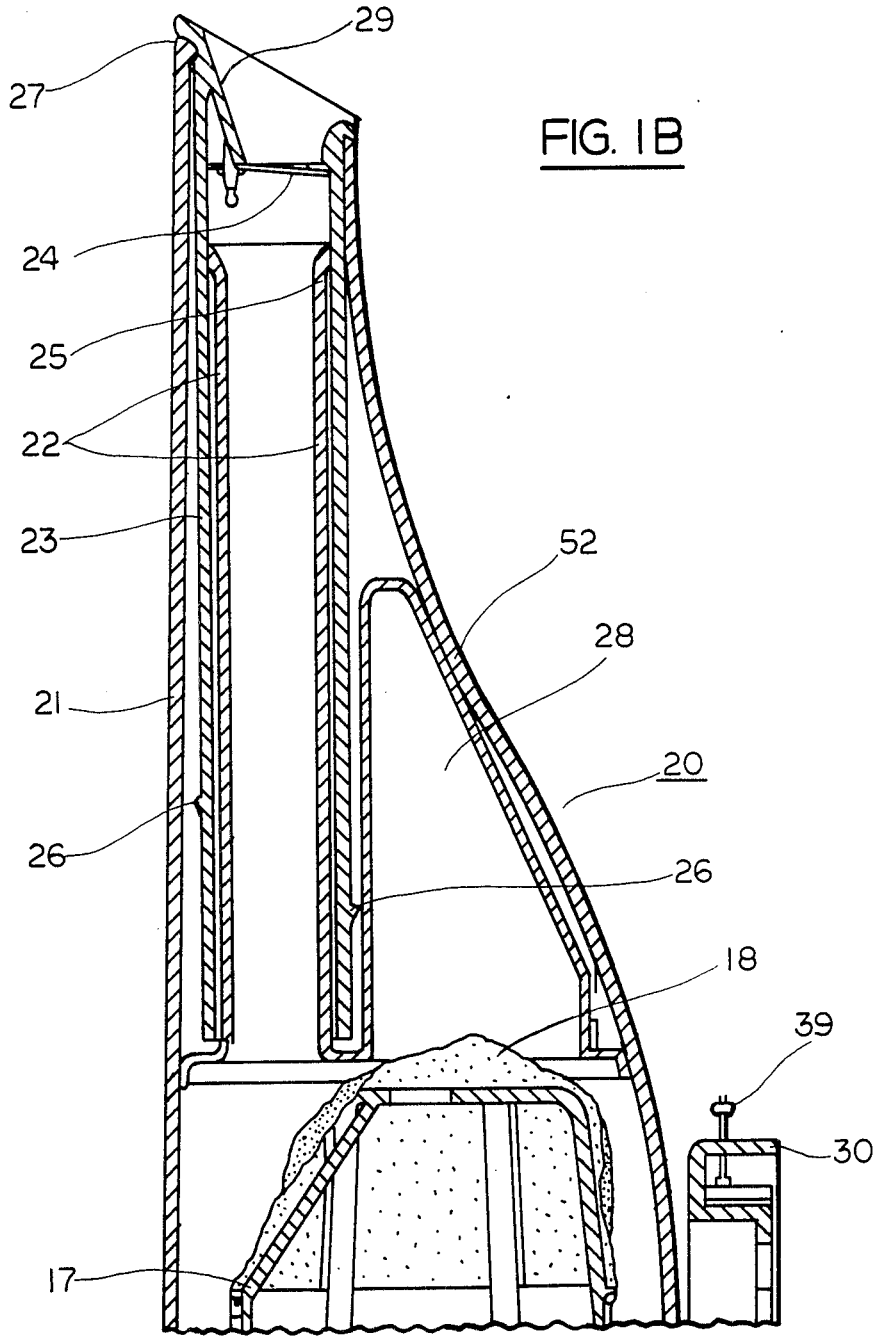

In FIGS. 1A and 1B, which are to be read together, there is depicted an elevational cross sectional view of a hand held vacuum cleaner comprising a second unit 1 and a first unit 20, held in interlocking position by button lock and hole arrangement 11,12,13 and protrusions 42 (see FIG. 3) and channels 43 (see FIG. 2), as will be discussed hereinbelow.

The second unit 1 comprises a housing structure 51 and handle 2; and contains therein motor 3; held by motor holder 8; fan 4 connected to and driven by motor 3; rechargeable battery 5; held within battery holder 6 and cover 7; and used to power motor 3 via a connector to switch 9 operated by switch handle 10; light 19 to indicate the operative condition of the apparatus; button locking member 11, normally held extended by spring 12; venturi 14 for suitably changing wind velocity for vacuuming action; and female charger plug holder 36, which is used to recharge battery 5. Instead of a battery, of course, a simple outside connection to electricity may be used.

Figure 2:
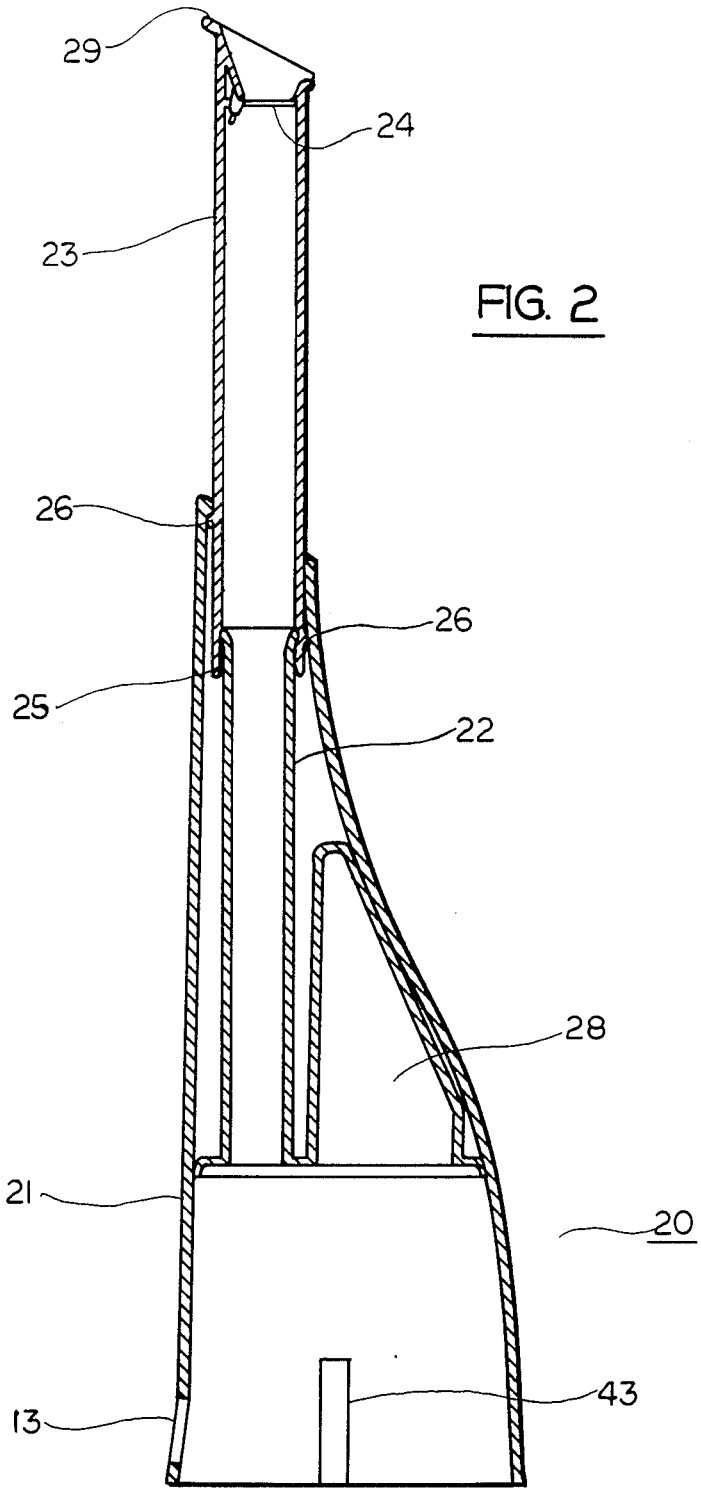
FIG. 2 depicts a part of the embodiment of FIG. 1, with the mouth in an extended position.
Figure 3:
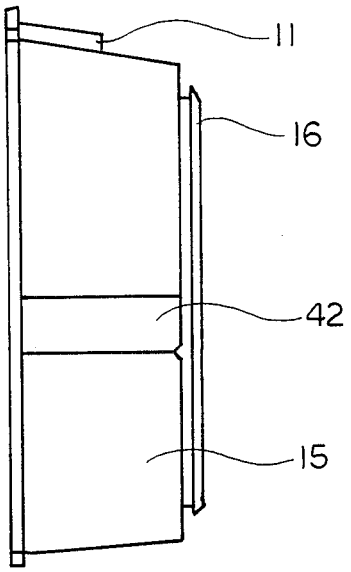
FIG. 3 is a side view of the interconnection part of the second unit, showing the protrusions used to hold the two units in alignment.

FIG. 3 shows a part 15 fit over the venturi and having a lip 16 to which a filter frame 17 (see FIGS. 1A,1B) is interconnected. Filter 18 is replaceably fit over and held by filter frame 17. Further in FIG. 3, a protruding part 42 (on both sides, that is in FIG. 3, both front and back sides of part 15) is shown extending substantially parallel to the center line of motor 3 and fan 4. The first unit 20 has formed therein a channel 43 (see FIG. 2) formed in both side walls, in locations aligned to snugly fit over corresponding protrusions 42, when the first and second units are interconnected.

The first unit 20 comprises a substantially planar top section 21 and a curved bottom section 52; and contained therein are cylindrical mouth extender comprising an inner cylinder 22 and an outer cylinder 23 telescoping from the retracted position shown in FIG. 1B to the extended position shown in FIG. 2; and a sealed dust collection space 28. The outer cylinder 23 is sealed to inner cylinder 22 by a suitable seal, such as felt or rubber, or the like, so that dust will not escape from within the cylinder to outside the cylinders. Also, the inner cylinder 22 has a flared end, near the seals, as depicted. A pair of stops 26 are disposed on the top and bottom of the outer cylinder 23 so that when the outer cylinder is extended, such as shown in FIG. 2, stops 26 will hold the outer cylinder 23 from coming apart from the first unit 20. At mouth 29 of outer cylinder 23, there is located an inward swinging flexible flap 24, such as made of rubber, plastic or the like, which normally closes mouth 29, and opens when vacuum action is taking place, by swinging toward the left in FIG. 1B or 2. The mouth 29 is shaped at a slant to fit mouth 27, of first unit 20, so that easy placement of the apparatus to the work area, can be realized. Mouth 27, and mouth 29, are both slanted, when viewed from the views shown in FIGS. 1B and 2.

As shown in FIG. 2, the outer cylinder 23 can be easily extended to extend mouth 29 for easy access of the mouth to otherwise inaccessible areas to be cleaned. With the seals 25 and flared ends of inner cylinder 22, dust will travel through mouth 29 past open flap 24, and through outer cylinder 23, inner cylinder 22, and into the inner space 28, without any dust leaking out the parts whereat the cylinders are connected to each other and to the unit. Space 28 is a sealed space which is accessible to filter 18 (see FIG. 1B) and which does not permit dust to escape into contact with the outside of cylinders 22 and 23. A suitable construction of the walls which define space 28, may be unitary construction with suitable seals to the top and bottom and side walls of unit 20, and suitably sealing the inner and outer cylinders at their contact points with the inner space of unit 20 and at the mouth 27.

Hole 13 is positioned at the top surface 21 of first unit 20, as shown, in the area whereat interlocking of the two units occurs. As shown in FIG. 1A, button 11, resiliently forced up by spring 12, fits through hole 13, to lock the first and second units together. To open the two units, such as for removal of collected dust, button 11 is depressed below the wall surface of hole 13 and unit 20 is pulled substantially straight out from unit 1. Depression channels 43 in the side walls of unit 20 will slide along in contact with protrusions 42 (see FIG. 3) until contact is broken and the two units are completely separated. Dust, then held in space 28, can be dumped out. To lock the two units together, the depressed side wall channels 43 are fit into contact with protrusions 42 corresponding to each channel, and the two units are pushed straight together, until button 11 at the top , is first pushed downward against spring force 12 by wall of unit 20, and then spring 22 will force the button 11 up through the hole 13, which then holds the two units locked together.

The inner cylinder 22 and outer cylinder 23 may be substantially rectangular in transverse cross section. The planar surface 21 of unit 20 conforms to such rectangular cylindrical shape.

Figure 4:
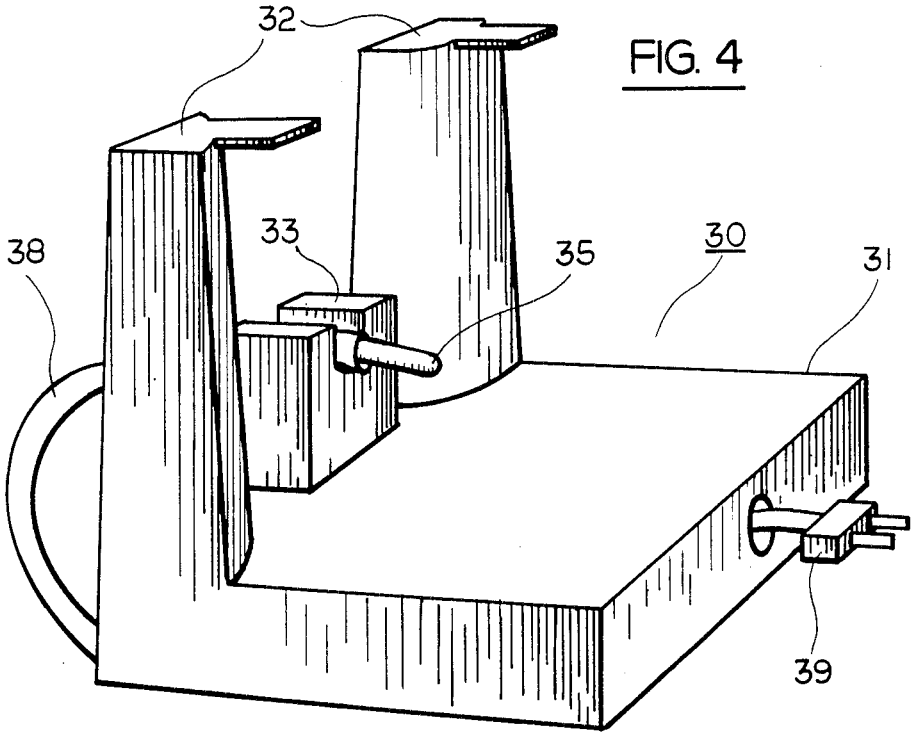
FIG. 4 is a perspective view of a charging holder unit.

Turning now to FIG. 4. and again to FIG. 1A, the interlocked first and second units may be placed on a charging holder unit 30 to charge battery 5. The unit 30 comprises base 31 and two orthogonally extending posts 32 between which the handle 2 is placed, with the bottom part of the unit held by base 31, in the manner depicted in FIGS. 1A,1B. On base 31 is disposed a charger plug holder 33, on which charging plug 35 may be placed. The interlocked first and second unit is placed with the handle as shown, and with the female plug holder 36 taking in charger plug 35, as depicted. In this manner, the units of the apparatus are held and the batter is charged. Also, below base 31 are a plurality of posts (See FIG. 1A), around which cord 38, attached to charger plug 35 may be wrapped around for storage. Also, a charger unit 37, may be placed below base 31, or outside as desired. Also, depicted is cord 38 having an inlet plug 39, which may be plugged into a house current outlet.

Figure 5:
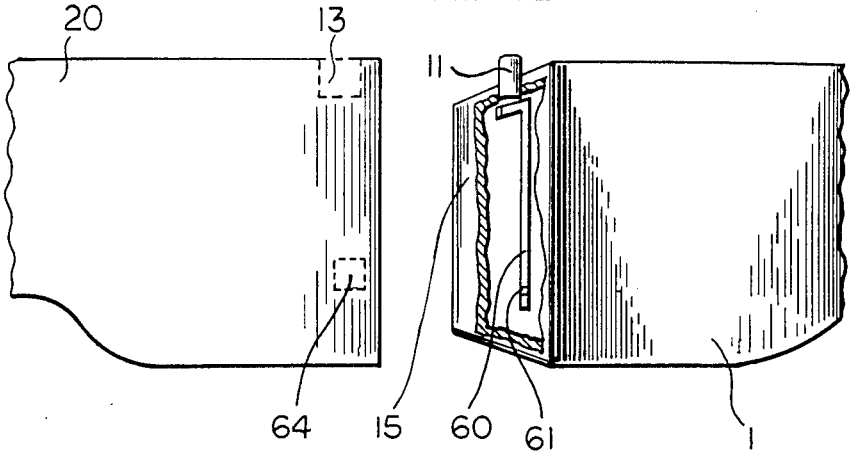
FIG. 5 is an elevational view of an alternative arrangement for locking together the two units.
Figure 6:
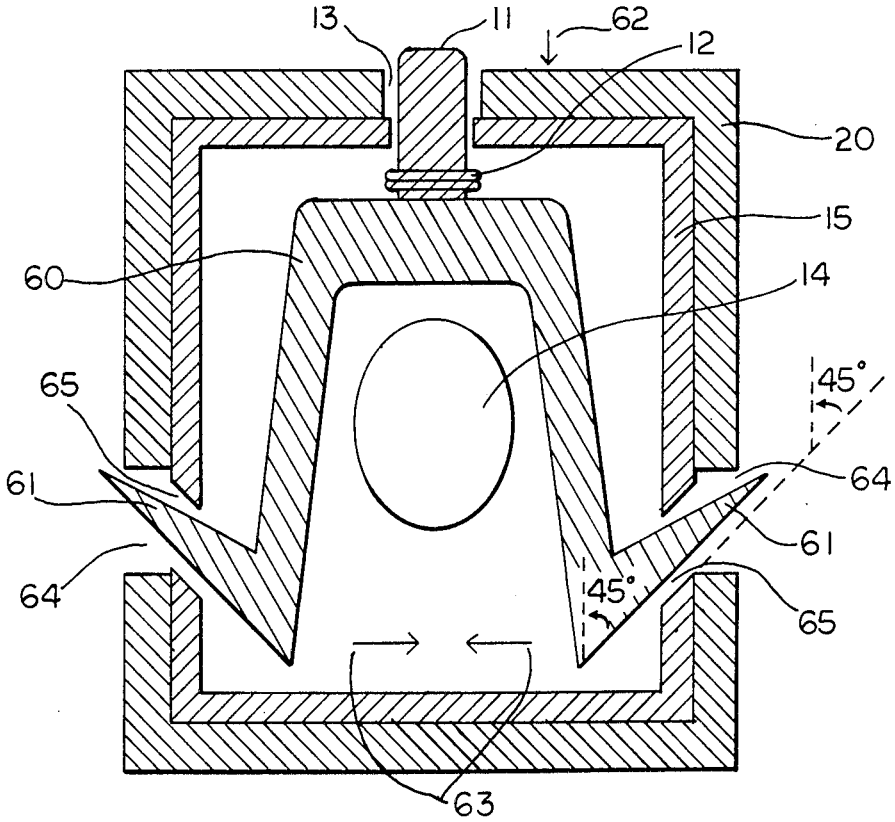
FIG. 6 depicts an end view of the interconnecting part of of the second unit showing the alternative locking arrangment and connected to the first unit.

Turning now to FIGS. 5 and 6, there is depicted an alternative arrangement for locking together the first and second units. In FIG. 5, the two units are shown in an unlocked apart position, With hole 13 and holes 64 of first unit 20 not having therein the lock button 11 and locking piece protrusions 61. Hole 64 is in both side walls of first unit 20, as shown in FIG. 6. Further in FIG. 5, second unit 1, has an interlocking piece 15 within which is contained locking piece 60 having legs to which are extended protrusions 61. The piece 15 is shown cut-away to more clearly show the locking piece 60, and other parts , such as frame 17, bag filter 18, etc, are not shown for clarity and simplicity of description.

In FIG. 6, there is depicted a locked condition of the two units, with first unit 20 fit over the interconnecting piece 15 of second unit 1, and button 11 within hole 13 of unit 20, with spring 12 resiliently upwardly holding the button in the hole. Fit around the venturi 14, is lock piece 60 having two legs (not numbered) and two protrusions 61, which are angled at the bottom portions and fit normally within and projecting outwardly through holes 65 in the side walls of interconnecting piece 15 , and holes 64 of first unit 20. The holes 64 and 65 are aligned with each other in both walls of their respective units, in interlocked position of the first and second units as depicted. Holes 65 are inclined ih the walls as depicted, preferably at 45° or less. The bottom part of protrusions 61 are similarly inclined at 45° or less. The angles are measured with respect to a line parallel to the direction of travel of the button 11.

In operation, the protrusions 61 normally project through holes 65 and outside of wall of piece 15. When the two units 1 and 20 are interlocked, the protrusions 61 will project through the pair of holes 64 and 65, which are aligned with each other, and in that position will hold the two units 1 and 20 locked together, in addition to the button 11 being within hole 13, so that the locking is done by the three points.

To unlock units 1 and 20, the button 11 is pushed downward, as shown by arrow 62, and the lock piece 60 willbe pushed downward, to cause the protrusions 61 to be pushed inwardly, as shown by arrows 63, due to the angular shape of protrusions 61 and holes 65. The protrusions will retract within the walls of unit 15, and out of holes 64 of unit 20. Button 11 will be below the wall surface of hole 13. The two units 1 and 20 are then, advantageously, pulled apart in a straight line.

To interconnect and lock the units 1 and 20, the button 11 is similarly pushed down, and the protrusions are retracted within the walls of unit 15, and the two units 1 and 20, pushed together advantageously, in a straight line, and when hole 13 is aligned with button 11, and holes 64 are aligned with hole 65, the button 11 is released to cause the protrusions 61 to project outwardly through holes 64 and 65, thereby locking the two units together with button 11 being in locking position within hole 13.

The lock piece 60 is preferably of material which is sufficiently rigid to enable force of the button being pushed down to travel to the protrusions 61 and to go against the wall of holes 65, and cause the protrusions 61 to be pushed inwardly.

Advantageously, the button means 11 may be connected to piece 60, so that spring 12 will act to normally push upward piece 60 and button means 11. Also, hole hole 64 in first unit 20 may be recesses (as shown in FIG. 5) in the inside surface of the walls or they may be holes which go completely through the walls (as shown in FIG. 6). With use of recesses, the outer surface of first unit 20 will be smooth and be advantageously neat in appearance.

Turning now to FIGS. 7 and 8, taken together, there is depicted a second alternative locking arrangement with the like elements having the same numerical designations. In FIG. 7, which shows a cut away side view, button 11 is shown connected to lock piece 60, and held within interconnecting part 15 with spring 12 which normally pushing upward button 11 and piece 60. In FIG. 8 which shows a cut away end view of piece 15 connected to first unit 20 (with button and spring means not shown for sake of clarity) piece 60 is normally held upward by force of spring 12, and has an oblong center hole to fit around venturi 14, and is connected movably by bolts 83 to rotate linkages 81 which pivot about pivot points 84. The linkages 81 have end pieces or protrusions 82 which are projected normally through holes 65 in the walls of part 15 and within recess 64 of walls in unit 20 (when the first unit 20 and second unit 1 are interconnected), or normally project out of holes 65 in part 15, when not so connected.

In operation, normally spring 12 will hold piece 60 upward and end pieces 82 will normally project through holes 65 in the walls of unit 15 andin recesses 64 of unit 20. (Recesses 64 may also be through holes, such as shown in FIG. 6). When button 11 is pushed downward, piece 60 will move downward, and bolt 83 will push downward linkages 81 to cause them to rotate about pivot points 84, and cause retraction of ends 82 from recesses 64 and holes 65. Then, the two units may be pulled apart, or if the units were apart, pushed together to interconnected them together.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. In a hand held vacuum cleaner comprising a first unit locked by lockin means to a second unit, said first unit comprising an outer housing, a dust inlet means, and contained within said housing a space for holding collected dust, said second unit comprising motor means, fan means, venturi means, and handle means; the improvement comprising, in combination said dust inlet means consisting of an extendible second telescoping cylinder having a first end and a second end and slidably fit about a first cylinder having a first end and a second end, said first cylinder being fixedly attached at said second end to and being completely within said outer housing of said first unit, with said first and second cylinders being separate from said outer housing, and mean for sealing said first and second cylinders against dust escaping from inside of said first and second cylinders, wherein said mean for sealing comprises a first seal disposed at the second end of said second cylinder and in contact with said first cylinder, a second seal disposed at the first end of said first cylinder and in contact with said second cylinder, and a third seal comprising means for fixedly attaching said second end of said first cylinder to said outer housing, said second cylinder being extendible outside of said outer housing and movably disposed with respect to said outer housing and having an opening in said first end and contained within said outer housing during non-use and extending outside of said housing for collecting dust, and said first cylinder having an opening at said second end opposite to said opening at said first end of said second cylinder for exiting of said dust into said space;

said space in said first unit being sealed by said third seal against dust leaking into contact with outside of said first and second cylinders;

said second unit further comprising a filter unit disposed within said space of said first unit when said first and second units are interlocked;

said locking means comprising a resilient button means disposed in an area at a top part of said second unit interconnected with and in contact with said first unit, a hole within a top part of said first unit at a position whereat said first and second units are interconnected, and at least a pair of protrusions disposed on two sides of said second unit, and a pair of corresponding channel means disposed on two sides of said first unit, whereby in an interlocking position, said protrusions and said channels are fitted together and said button is in said hole;

flexible means for opening and closing said opening at said first end of said second cylinder; and means for preventing said second cylinder from being completely removed from said first cylinder comprising protrusions about said second cylinder of dimensions greater than said dust inlet means.

2. The apparatus of claim 1, wherein said mouth piece has a flexible flap disposed at said opening of said second cylinder.

3. The apparatus of claim 1, wherein said first and second cylinders are straight rectangular cylinders, and wherein said first unit has its top part of substantially planar surface from said mouth to said hole.

4. The apparatus of claim 3, wherein said first unit has said space located below said first and second cylinders.

5. The apparatus of claim 1, wherein said first and second cylinders are sealed at their interconnection with flexible material.

6. The apparatus of claim 1, wherein said second unit holds a rechargeable battery.

7. The apparatus of claim 1, wherein said filter unit comprises a filter holder attached to said second unit, and a replaceable filter disposed over and held by said filter holder.

8. The apparatus of claim 1, wherein said second cylinder has stops attached thereto to limit outward extension of said second cylinder.

9. The apparatus of claim 1, wherein said protrusions are slidably fitted into said channels.

10. The apparatus of claim 1, wherein said protrusions are at 45° angles.

11. In hand held vacuum cleaner comprising a first unit locked by locking means to a second unit, said first unit comprising an outer housing, a mouth piece and contained within said outer housing a space for holding collected dust, said second unit comprising motor means, fan means, venturi means, and handle means, the improvement comprising, in combination:

said mouth piece comprising an extendible cylinder disposed within said outer housing and having at least a second cylinder slidably fit into or about a first cylinder, and means for sealing said first and second cylinders against dust escaping from inside of said first and second cylinders, said second cylinder extendible outside of said outer housing and movably disposed with respect to said outer housing and having an opening at an end thereof extending outside of said housing for collecting dust, and said first cylinder secured within said outer housing and having an opening for exiting of said dust into said space;

said space in said first unit being sealed against dust leaking into contact with outside of said first and second cylinders;

said second unit further comprising a filter unit disposed within said space of said first unit when said first and second units are interlocked;

said locking means comprising a resilient button means disposed in an area of said second unit interconnected with said first unit, a hole within said first unit at a position whereat said first and second unit are interconnected, and at least a pair of protrusions on two sides of said second unit, and a pair of corresponding channel means on said first unit, whereby in an interlocking position, said protrusions and said channels are fitted together and said button is in said hole;

said second unit containing a rechargeable battery for powering said motor means; and charger holder means for holding said apparatus, comprising a flat rectangular base having a top surface and a hollow bottom part and two posts extending vertically from an end part of said top surface of said base, said posts holding sad handle of said second unit with said second unit lying on said base, said holding means further comprising a further post extending vertically from said end part of said top surface of said base and disposed between said two posts, and holding a charging plug therein, and a plurality of posts disposed extending vertically downward in said hollow bottom part of said base, said plurality of posts being useable around which a cord attached to said charging plug may be wound for storage.

12. The apparatus of claim 11, wherein said protrusions are slidably fitted into said channels.

13. The apparatus of claim 11, wherein said protrusions are at 45° angles.

14. In a hand held vacuum cleaner comprising a first unit locked by locking means to a second unit, said first unit comprising a mouth piece and a space for holding collected dust, said second unit comprising motor means, fan means, venturi means, and handle means; the improvement comprising said locking means comprising a resilient button means disposed at a top surface of said second unit in an area interconnectable to said first unit; a first hole within a top wall of said first unit, whereat said first and second units are interconnectable and to be aligned with said button means when interconnected; a pair of second holes within opposite side walls of said second unit whereat said first and second units are interconnectable; and a lock piece comprising a pair of protrusions normally projecting outwardly from said pair of second holes, said lock piece disposed to be operable by said button means, whereby said button means is operable to push downwardly said lock piece to cause said protrusions to move toward each other and retract from said pair of second holes, wherein said lock piece comprises a plate means connected to said button means, and a pair of linkages connected to said protrusions and connected rotatably to said plate, said linkages being pivotally movable upon movement of said plate to retract or project said protrusions, and wherein said wall of said first unit has a pair of recesses therein, into which said protrusions fit in a locked position of said first and second units.

15. The apparatus of claim 14, wherein said protrusions are shaped to be 45° or less and the walls of said second holes are at 45° or less, said angles being with respect to the said downward direction of movement of said button means.

16. The apparatus of claim 14, wherein said lock piece comprises a plate means connected to said button means, and a pair of linkages connected to said protrusions and connected rotatably to said plate, said linkages being pivotally movable upon movement of said plate to retract or project said protrusions.

17. The apparatus of claim 16, wherein said wall of said first unit has a pair of recesses therein, into which said protrusions fit in a locked position of said first and second units.

18. In a hand held vacuum cleaner comprising a first unit attachable to a second unit, said first unit comprising an outer housing, a mouth piece, and contained within said outer housing a space for holding collected dust, and said second unit comprising motor means, fan means and handle means; the improvement wherein said mouth piece consists of a second extendible telescoping cylinder having a first end and a second end slidably about a first cylinder having a first end and a second end, and means for sealing said first and second cylinders against dust escaping from inside of said first and second cylinders comprising first seal disposed at said second end of said second cylinder and in contact with said first cylinder, a second seal disposed at said first end of said first cylinder and in contact with said second cylinder, and a third seal comprising means for fixedly attaching said second end of said first cylinder to said outer housing, said second cylinder extending outside of said first unit outer housing when collecting dust and being completely within said outer housing during non-use, and said first cylinder being fixedly attached by said third seal at said second end to and completely with within said outer housing and havng an opening at said second end opposite to an opening at said first end of said second cylinder for exiting of said dust into said space, and wherein said first and second cylinders are separate from said outer housing; and flexible means for opening and closing said opening at said first end of said second cylinder; and means for preventing said second cylinder from being completely removed from said first cylinder when collecting dust comprising protrusions about said second cylinder of dimensions greater than said mouth piece.

19. The vacuum cleaner of claim 18, wherein said space in said first unit is sealed against dust leaking into contact with outside of said first and second cylinders.

* * * * *